US005292074A

United States Patent [19]

Clark et al.

[11] Patent Number: 5,292,074

[45] Date of Patent: Mar. 8, 1994

[54] POOL FILTER SPRAY HEAD APPARATUS

[76] Inventors: Steven J. Clark; Evelyn J. Clark, both of 324 Ballet Dr., Las Vegas, Nev. 89107

[21] Appl. No.: 31,702

[22] Filed: Mar. 15, 1993

[51] Int. Cl.[5] ..... B05B 15/08

[52] U.S. Cl. ..... 239/546; 239/565; 239/587.2; 239/587.6; 239/588; 134/199; 134/900; 210/407

[58] Field of Search ..... 239/567, 550, 565, 266-269, 239/547, 587.1, 587.2, 587.6, 588, 546; 134/199; 285/184, 114, 119; 210/412, 407, 409, 169

[56] References Cited

U.S. PATENT DOCUMENTS

| | | | |
|---|---|---|---|
| 1,150,502 | 8/1915 | Colidge | 285/184 |
| 3,185,397 | 5/1965 | Nelson | 239/567 |
| 3,563,474 | 2/1971 | Robinson | 239/566 |
| 3,820,552 | 6/1974 | Lang et al. | 210/409 |
| 3,994,443 | 11/1976 | Shenker | 239/567 |
| 4,010,898 | 3/1977 | Williams | 239/567 |
| 4,245,786 | 1/1981 | Abrahamsen et al. | 239/602 |
| 4,535,938 | 8/1985 | Lindabury, Sr. | 239/587.6 |
| 4,639,018 | 1/1987 | Froelich et al. | 285/184 |
| 4,709,717 | 12/1987 | Rannigan et al. | 239/567 |
| 4,778,111 | 10/1988 | Leap | 239/567 |

FOREIGN PATENT DOCUMENTS

| | | | |
|---|---|---|---|
| 837189 | 4/1952 | Fed. Rep. of Germany | 47/1 B |
| 2108190 | 9/1972 | Fed. Rep. of Germany | 239/567 |
| 307176 | 4/1933 | Italy | 239/567 |
| 99033 | 11/1961 | Norway | 239/567 |
| 2235637 | 3/1991 | United Kingdom | 239/567 |

*Primary Examiner*—Karen B. Merritt
*Attorney, Agent, or Firm*—Leon Gilden

[57] ABSTRACT

A rigid primary conduit directs fluid into an arcuate manifold. The arcuate manifold includes a concave surface having a plurality of spray nozzles directed into the manifold in fluid communication with the primary conduit to direct individual spray applications about the surface of an associated pool filter to enhance cleaning thereof.

3 Claims, 4 Drawing Sheets

FIG. 1
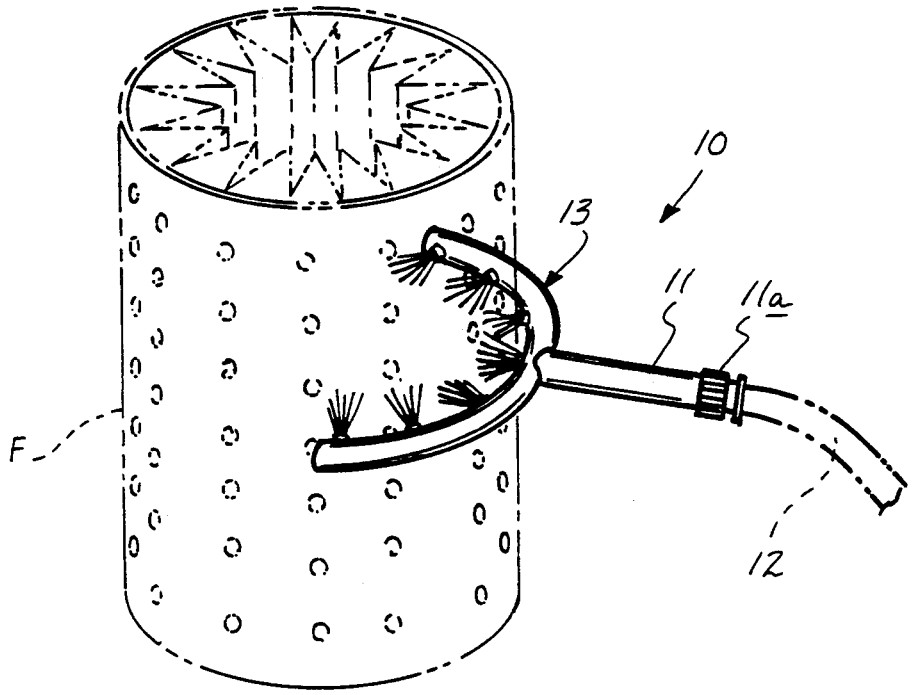
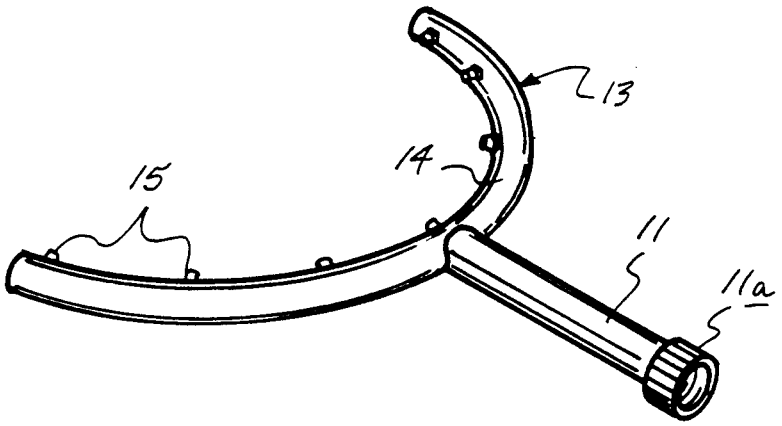
FIG. 2

FIG. 3
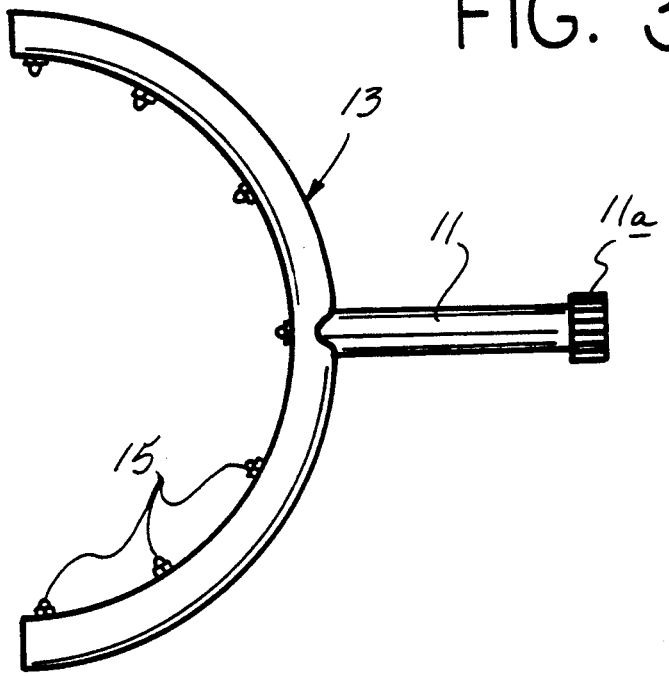
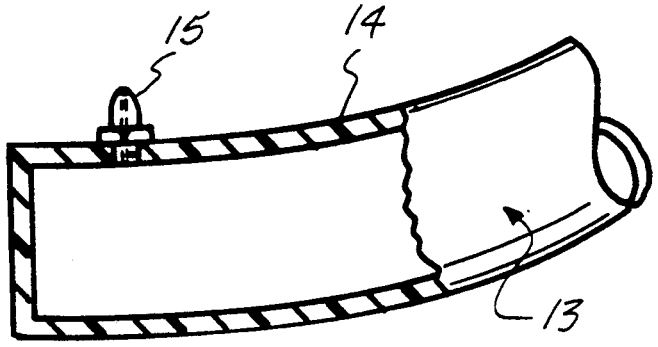
FIG. 4

FIG. 5
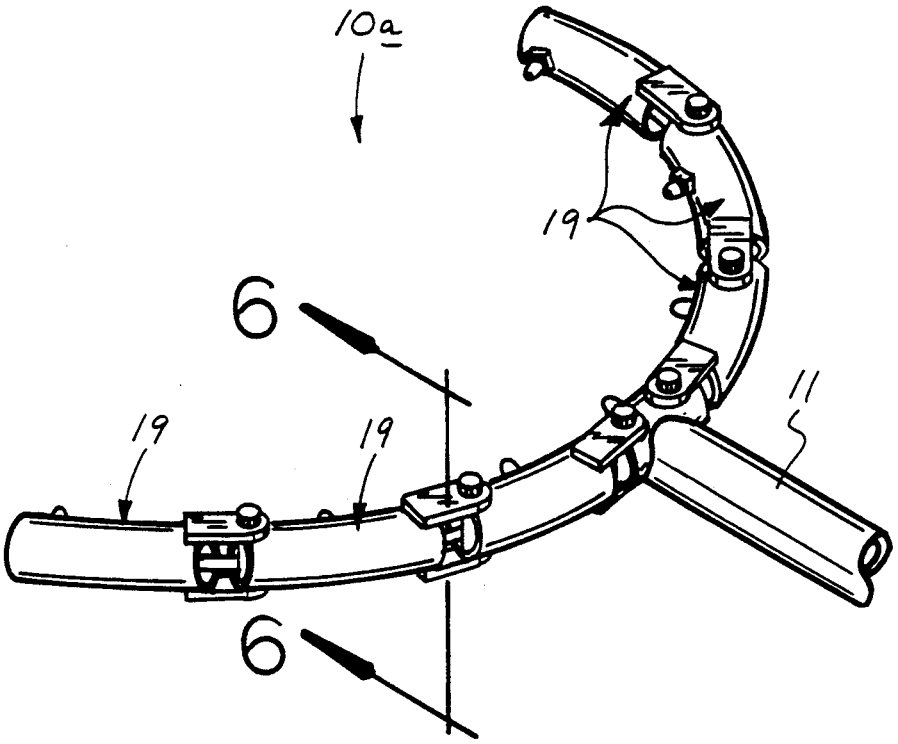
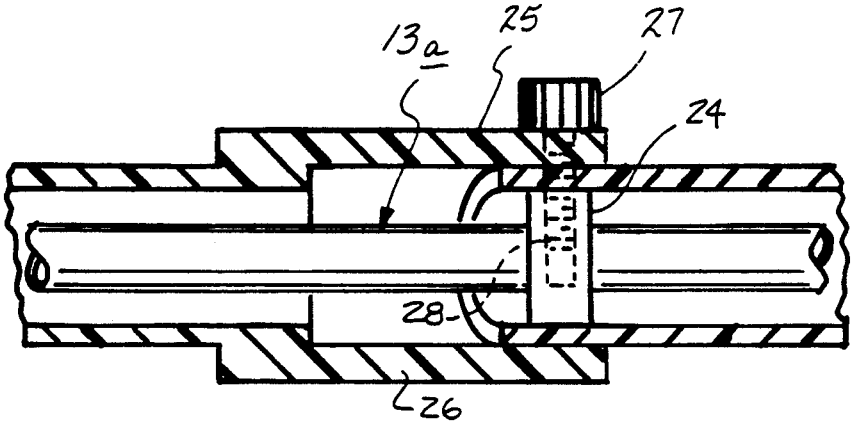
FIG. 6

FIG. 7
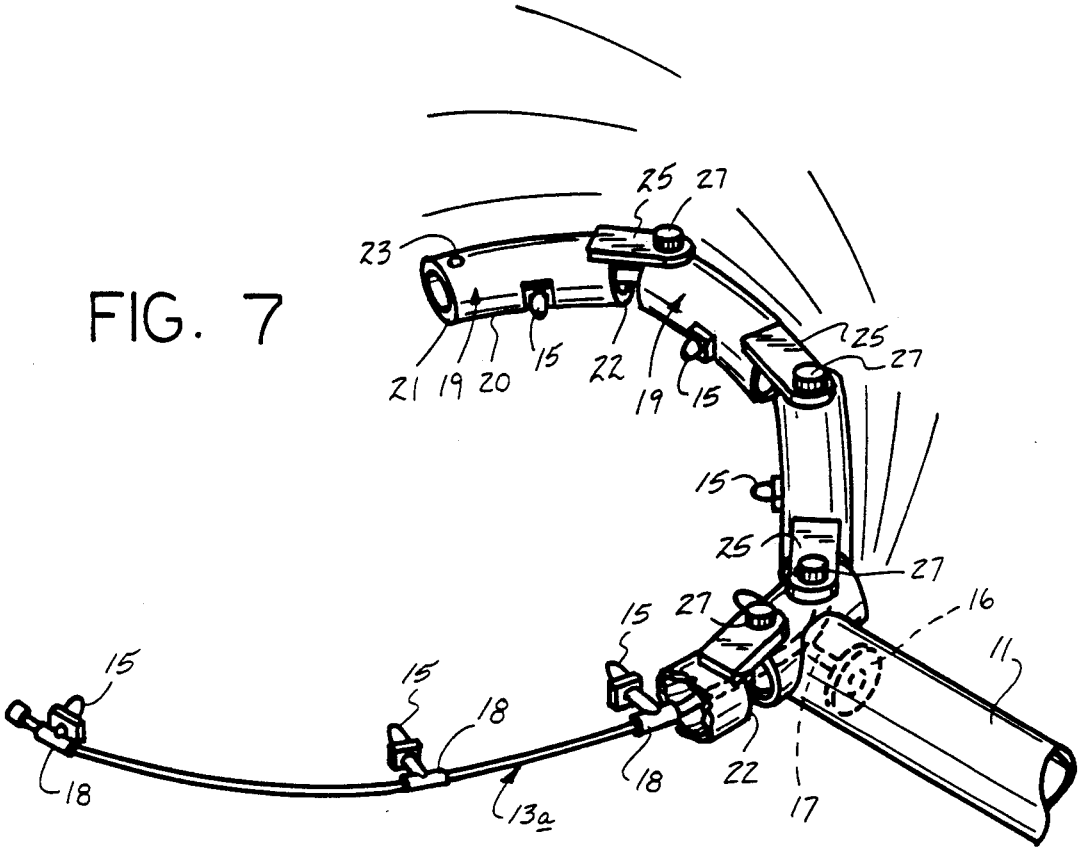
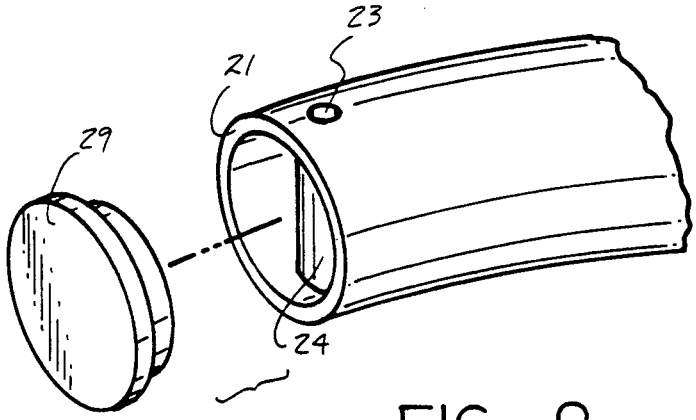
FIG. 8

POOL FILTER SPRAY HEAD APPARATUS

BACKGROUND OF THE INVENTION

1. Field of the Invention

The field of invention relates to spray apparatus, and more particularly pertains to a new and improved pool filter spray head apparatus wherein the same is directed to the directing of an arcuate spray of water against a swimming pool filter to enhance cleaning of the filter.

2. Description of the Prior Art

Typically, swimming pool filters are cleaned utilizing a garden hose and the garden hose directed onto the surface of the swimming pool filter. The instant invention attempts to overcome deficiencies of the prior art by employing an arcuate manifold directing individual sprays of enhanced flow through the nozzles directed onto the surface of the pool filter.

Prior art nozzle spray attachments are indicated in U.S. Pat. Nos. 3,497,141; 4,369,921; 4,575,270; and 4,840,313.

SUMMARY OF THE INVENTION

In view of the foregoing disadvantages inherent in the known types of spray nozzle apparatus now present in the prior art, the present invention provides a pool filter spray head apparatus wherein the same is directed to effect concentrated pressurized cleaning of a swimming pool filter utilizing a semi-circular array of fluid nozzles. As such, the general purpose of the present invention, which will be described subsequently in greater detail, is to provide a new and improved pool filter spray head apparatus which has all the advantages of the prior art spray head structure and none of the disadvantages.

To attain this, the present invention provides a rigid primary conduit directing fluid into an arcuate manifold. The arcuate manifold includes a concave surface having a plurality of spray nozzles directed into the manifold in fluid communication with the primary conduit to direct individual spray applications about the surface of an associated pool filter to enhance cleaning thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pool filter spray head apparatus which has all the advantages of the prior art spray head structure and none of the disadvantages.

It is another object of the present invention to provide a new and improved pool filter spray head apparatus which may be easily and efficiently manufactured and marketed.

It is a further object of the present invention to provide a new and improved pool filter spray head apparatus which is of a durable and reliable construction.

An even further object of the present invention is to provide a new and improved pool filter spray head apparatus which is susceptible of a low cost of manufacture with regard to both materials and labor, and which accordingly is then susceptible of low prices of sale to the consuming public, thereby making such pool filter spray head apparatus economically available to the buying public.

Still yet another object of the present invention is to provide a new and improved pool filter spray head apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in use.

FIG. 2 is an isometric illustration of the invention.

FIG. 3 is an orthographic side view of the invention.

FIG. 4 is an enlarged orthographic view, partially in section, of an end portion of the arcuate manifold of FIG. 1.

FIG. 5 is an isometric illustration of a modified aspect of the invention.

FIG. 6 is an orthographic view, taken along the lines 6—6 of FIG. 5 in the direction indicated by the arrows.

FIG. 7 is an isometric illustration of the invention, partially removed, to indicate the modified manifold mounted therewithin.

FIG. 8 is an enlarged isometric end view of an arcuate tubular segment.

DESCRIPTION OF THE PREFERRED EMBODIMENT

With reference now to the drawings, and in particular to FIGS. 1 to 8 thereof, a new and improved pool filter spray head apparatus embodying the principles and concepts of the present invention and generally designated by the reference numerals 10 and 10*a* will be described.

More specifically, the pool filter spray head apparatus 10 of the instant invention essentially comprises a rigid primary conduit 11 arranged for securement to a fluid supply conduit 12 through a coupling 11*a* at a first end of the primary conduit 11. A second end of the primary conduit 11 includes a rigid arcuate manifold 13 fixedly mounted thereto, having a concave surface 14. Mounted through the concave surface 14 is a semi-annular array of nozzles 15 in fluid communication with the arcuate manifold 14 and the primary conduit 11. In this manner, and as illustrated in FIG. 1, the manifold 13 is oriented in adjacency relative to a pool filter "F" as typically utilized in a swimming pool environment, wherein application of the nozzles 15 about the exterior surface of the filter "F" permits enhanced and more rapid cleaning of the filter and debris lodged therewithin.

The apparatus 10*a*, as indicated in FIGS. 5 and 7, includes a primary conduit 11 in fluid communication with a modified flexible manifold 13*a*, having the nozzles 15 in fluid communication with the manifold 13*a* and its concave surface through a manifold coupling 18. The flexible manifold 13*a* is positioned within a plurality of arcuate tubular segments 19, with each of the segments having a tubular segment concave surface 20 receiving a single nozzle 15 medially of the concave surface 20 of each segment. Each segment 19 includes a first end 21 spaced from a second end 22. The first end 21 includes a first end aperture 23 in communication with an internally threaded tube 24. Each second end includes a first plate member 25 mounted integrally to the segment projecting beyond the second end 22 spaced parallel to and in a coextensive relationship to a second plate member 26 to receive an adjacent segment first end 21 therebetween, whereupon a fastener 27 having an externally threaded shank 28 is directed through the first plate member 25 and received through the first end aperture 23 and the internally threaded tube 24 of the adjacent tubular segment. If desired, a first end cap 29 is mounted within an outermost segment 19, as indicated in FIG. 8, to prevent debris from entering the segment in use. Further, as illustrated in FIG. 7, an end plate 16 mounted within the primary conduit 11 includes an end plate conduit 17 in fluid communication with the flexible manifold 13*a* to enhance the velocity of water or other suitable fluids through the end plate conduit 17 and the associated manifold 13*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pool filter spray head apparatus, comprising, a rigid primary conduit, having a conduit first end, with the first end including a coupling mounted thereon, wherein the rigid primary conduit includes a second end, and an arcuate manifold in fluid communication with the rigid primary conduit through the second end, and the arcuate manifold having a concave coextensive surface and the concave coextensive surface includes a semi-annular array of nozzles spaced an equal distance relative to one another along the concave surface, and each of the nozzles are spaced from the concave surface about a manifold coupling, and a plurality of arcuate tubular segments receive the arcuate manifold therethrough, and each of the arcuate tubular segments are pivotally mounted relative to one another.

2. An apparatus as set forth in claim 1 wherein each of the tubular segments includes a tubular segment concave surface, and each tubular segment concave surface includes one of said nozzles directed medially thereof.

3. An apparatus as set forth in claim 2 wherein each of the tubular segments includes a segment first end and a segment second end, each segment first end includes a first end aperture in communication with an internally threaded tube positioned within each segment, each segment second end includes a first plate member and a second plate member extending longitudinally beyond said segment second end, and said first plate member includes a fastener directed therethrough, and the fastener is arranged for reception within the internally threaded tube of an adjacent one of said tubular segments.

* * * * *